US005681492A

United States Patent [19]

Van Praet

[11] Patent Number: 5,681,492

[45] Date of Patent: Oct. 28, 1997

[54] INCUBATOR FOR MICRO TITER PLATES

[76] Inventor: Peter Van Praet, Bergenstraat 49, 3053 Haasrode, Belgium

[21] Appl. No.: 602,288

[22] Filed: Feb. 16, 1996

[30] Foreign Application Priority Data

Feb. 17, 1995 [BE] Belgium ..... 09500135

[51] Int. Cl.[6] ..... F24C 15/32; B01L 7/02

[52] U.S. Cl. ..... 219/400; 219/386; 237/3; 237/14; 435/809

[58] Field of Search ..... 219/388, 400, 219/401, 385, 386; 237/3, 14; 435/809; 34/219, 221

[56] References Cited

U.S. PATENT DOCUMENTS 3,618,734 11/1971 Khan ..... 34/219
4,750,276 6/1988 Smith et al. ..... 126/21 A
5,061,448 10/1991 Mahe et al. ..... 219/400
5,069,380 12/1991 Deambrosio ..... 219/388
5,239,917 8/1993 Lutkie et al. ..... 126/21 A
5,307,144 4/1994 Hiroshi et al. ..... 356/244
5,405,074 4/1995 Den Dopper et al. ..... 219/388
5,459,300 10/1995 Kasman ..... 435/809

*Primary Examiner*—Teresa J. Walberg
*Assistant Examiner*—F. Pelham
*Attorney, Agent, or Firm*—Breiner & Breiner

[57] ABSTRACT

An incubator is provided wherein the individual wells of a Micro Titer Plate are heated by means of a continuous temperature regulated flow of warm air (typically 37° C.) blowing through a series of holes from a plate underneath onto the bottom of the wells. A typical Micro Titer Plate can have 96 wells and is used, for example, in medical laboratories. The volume of a well is typically 0.35 milliliter. Both the end temperature and the way the end temperature is reached is the same for all individual wells and is not dependent on either the location of the well on the Micro Titer Plate or its surrounding by other wells.

10 Claims, 1 Drawing Sheet

INCUBATOR FOR MICRO TITER PLATES

1. Field of the Invention

Figure 1:
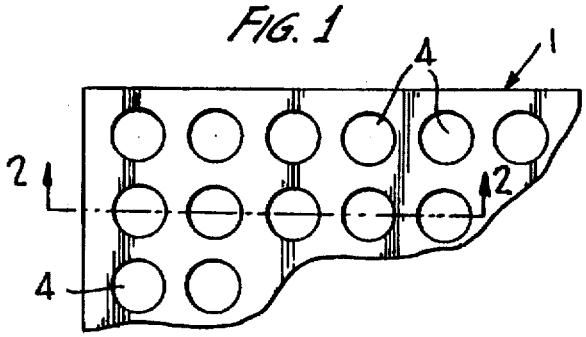

The present invention is directed to an incubator for use in carrying out chemical reactions in a medical or other type laboratory environment. More particularly, the invention is directed to a incubator for receiving a micro titer plate having a plurality of wells for carrying out a chemical reaction wherein the plate is uniformly heated.

2. Background of the Invention

A Micro Titer Plate (MTP) for use in an incubator designed for medical or other laboratories is conventionally constructed from a piece of plastic containing a plurality of wells. The number of wells can, for example, be 96, organized as an array of 12 times 8 wells. Usually, a number of wells are linked together into a strip. Such a strip can typically have 8 or 12 wells. In these wells, each with a volume of approximately 0.35 milliliter, chemical temperature dependent reactions are performed. The dimensions of a standard Micro Titer Plate are + or −90×130 milliliter with a height of approximately 16 millimeters. The Incubator is designed to bring the MTP to a constant temperature and keep it at this temperature. This temperature can typically be 37 degrees Celsius or any other adjustable temperature.

In the prior art two types of incubators are known, as follows:

A) The wet incubator.

In this incubator the same thermal treatment is applied to all wells of the MTP by immersing the wells in a warm water bath. The water temperature of the bath is kept constant and the water can be stationary or circulating.

Advantages of a wet incubator are that:

The end temperature is reached quickly.

There is uniform distribution of temperature throughout the plate.

Disadvantages of the wet incubator are that:

There is a wet environment.

There is a chance of bacteria growth in the waterbath.

It is not a compact unit.

B) The dry incubator.

With this incubator the MTP is placed on top of a metal plate or block which is heated electrically by means of a heating element and the temperature is kept constant by means of a temperature sensor and an electric temperature regulator.

The advantage of this incubator is:

A dry environment.

The disadvantages are that:

The end temperature is reached slowly.

There are edge effects resulting in the fact that wells on the outside of the MTP warm up faster than those in the center of the MTP. The reason for this is that wells from the center of the MTP are all surrounded by cold neighboring wells, whereas the wells located at the edge of the MTP are surrounded by cold wells on one side only. This can be compensated by providing the outside of the heating block with a higher temperature than the inside.

In case a MTP is not complete because some strips have been removed, more edge effects will occur.

Compensating is difficult.

OBJECTS OF INVENTION

The objects of the present invention are to provide an incubator where a) the temperature trajectory to go from an initial low temperature to a higher temperature and b) the final temperature of the well itself is independent from both the location of the well in the MTP and its surroundings. The incubator is to be compact permitting integration into an automate.

Other objectives of the invention will be apparent from the following description.

GENERAL DESCRIPTION OF THE INVENTION

An incubator for MTPs is provided containing:

a positioning device or holder on which one or more MTP can be placed, a perforated plate at a predetermined distance beneath the positioning device or holder, an inlet for receiving warm air, one or more elements to perform an homogeneous mixing of the warm air, and a temperature sensor.

The perforations of the perforated plate are arranged in such a way that uniform heating of the MTP is obtained.

DRAWINGS AND DETAILED DESCRIPTION

Figure 2:
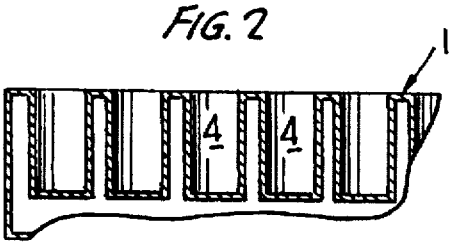
Figure 3:
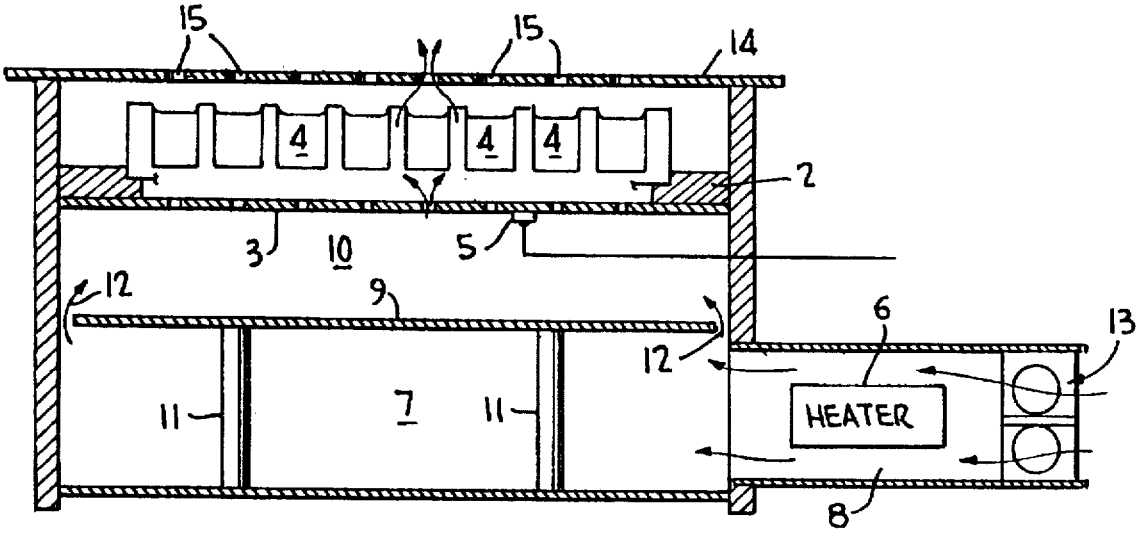

A more complete understanding of the incubator of the present invention is apparent from the drawing where FIG. 1 is a top view of a micro titer plate, FIG. 2 is a cross-sectional view of the MTP of FIG. 1 taken along line 2—2 thereof, and FIG. 3 is a sectional view of an incubator of the present invention utilizing a MTP of FIGS. 1 and 2.

According to the present invention, the transfer of the heat to the liquid in the different wells of the MTP is not done via a waterbath (as with the wet incubator) nor via static convection (as with the dry incubator) but via dynamic convection. This is realized by gently blowing a temperature regulated stream of warm air against the bottom of each individual well of the MTP.

The MTP, as shown in FIG. 3, is placed on a positioning device 2 within an incubator. A perforated metal plate 3, for example of aluminum and being 1 millimeter thick, is placed at a predetermined distance underneath MTP 1. The perforations correspond to the locations of the wells 4. The warm air from underneath the perforated plate escapes upwards through these perforated holes and flows against the bottom and the side of the individual wells. This results in wells which are permanently surrounded by warm air.

A temperature sensor 5 is attached to the perforated metal plate 3 and is connected to an electronic regulator that keeps the metal plate at a constant temperature by switching a heater on and off. With this dynamic setup the heat transfer is much larger than with the stationary warm air approach. The end temperature is reached more quickly. With the arrangement of the invention the presence (or absence) of neighboring wells is of neglectible effect on the way the wells reach their end-temperature and the end-temperature itself. For the chemical reactions going on in the wells, both the end-temperature and the way the end-temperature is reached are equally important. The way the end-temperature of the well is reached (temperature profile) depends on the magnitude of the flux of warm air and its temperature.

After passing along heating element 6, the air is mixed homogeneously in a lower mixing chamber 7. The lower mixing chamber is connected to the warm air inlet 8. The mixing chamber 7 is a simple empty space sealed on all sides except on the top side where a plate 9 with slightly smaller length and width dimensions is located. This plate separates the lower chamber 7 from an upper chamber 10 of the mixing arrangement. The plate is supported by pillars 11. The plate can easily be removed for cleaning purposes. The small opening 12 surrounding the plate allows the mixed warm air from the lower mixing chamber 7 to escape in a uniform manner to the upper mixing chamber 10. This is only one of the many possible mixing techniques.

The air flow is created by a ventilator 13 which aspirates ambient air and passes the air over heating element 6. An electronic circuit switches the heater on and off in order to keep the perforated plate with its temperature sensor at a constant temperature.

A cover 14 with holes 15 can optionally be placed on top of the MTP. This reduces well to well temperature differences even more. The holes can be of such a diameter that they will allow the needles from a pipetting automate to access the wells while the MTP is still located on the Incubator. If this cover plate is opaque, it will shield the wells from ambient light and this can be an advantage for some chemical reactions.

Although only a preferred embodiment of the invention has been specifically illustrated and described, it is understood that variations may be made in the invention without departing from the spirit of the invention and within the scope of the appended claims.

It is claimed:

1. An incubator for holding at least one micro titer plate (MTP) having a plurality of wells comprising a positioning device on which at least one MTP is placed, a perforated plate spaced beneath said MTP at a predetermined distance, an inlet in said incubator for receiving warm air in a chamber located in said incubator below said perforated plate, at least one element to provide homogeneous mixing of said warm air, a temperature sensor, and a perforated cover plate facilitating access to at least a portion of said plurality of said wells during the period of incubation, wherein the perforations of said perforated plate spaced beneath said MTP are constructed and arranged to provide uniform heating of said wells of said MTP.

2. An incubator according to claim 1 wherein the perforated plate is metal.

3. An incubator according to claim 1 or 2 wherein the perforations correspond substantially with the locations of the individual wells of the MTP and are arranged in such a manner that the temperature distribution across the plate is uniform.

4. An incubator according to claim 1 or 2 wherein a feedback mechanism controls the temperature of the circulating air.

5. An incubator according to claim 3 wherein a feedback mechanism controls the temperature of the circulating air.

6. An incubator according to claim 1 or 2 wherein the distance between the perforated plate and the MTP is from 1 to 15 millimeters.

7. An incubator according to claim 3 wherein the distance between the perforated plate and the MTP is from 1 to 15 millimeters.

8. An incubator according to claim 1 or 2 wherein a ventilator and a heating element are mounted in a warm air supply channel.

9. An incubator according to claim 3 wherein a ventilator and a heating element are mounted in a warm air supply channel.

10. An incubator according to claim 1 wherein the homogeneous mixing of warm air is realized by means of two mixing chambers, said mixing chambers being separated by a plate with slightly smaller dimensions allowing the air from the lower mixing chamber to flow to the upper mixing chamber.

* * * * *